United States Patent [19]

Knox

[11] Patent Number: 4,571,162

[45] Date of Patent: Feb. 18, 1986

[54] OIL WELL SUCKER ROD SHOCK ABSORBER

[75] Inventor: Floris B. Knox, Robinson, Ill.

[73] Assignee: Ira M. Patton, Lawrenceville, Ill.

[21] Appl. No.: 708,108

[22] Filed: Mar. 5, 1985

Related U.S. Application Data

[63] Continuation of Ser. No. 402,417, Jul. 28, 1982, abandoned.

[51] Int. Cl.[4] ..... F04B 21/04; F16F 9/00

[52] U.S. Cl. ..... 417/554; 92/84; 267/125

[58] Field of Search ..... 92/84; 74/582, 583; 267/125; 188/286, 287

[56] References Cited

U.S. PATENT DOCUMENTS

| | | | |
|---|---|---|---|
| 875,372 | 12/1907 | Palm | 417/554 |
| 1,520,058 | 12/1924 | Gibson | 417/541 |
| 1,785,559 | 12/1930 | Ponti | 74/582 |
| 2,087,590 | 7/1937 | Brazell | 417/545 |
| 2,153,816 | 4/1939 | Stevens | 267/125 |
| 2,372,472 | 3/1945 | Campbell | 74/582 |
| 2,383,136 | 8/1945 | Laurain | 74/582 |
| 2,861,795 | 11/1958 | Blake | 188/287 |
| 3,021,794 | 2/1962 | Knox | 417/554 |
| 3,062,154 | 11/1962 | Ward | 417/541 |
| 3,272,145 | 9/1966 | Towner | 417/541 |
| 3,376,826 | 4/1968 | Crowe | 417/554 |
| 3,598,206 | 8/1971 | Henwells | 188/287 |
| 3,963,228 | 6/1976 | Karle | 267/125 |
| 4,049,365 | 9/1977 | Sparks | 417/554 |
| 4,133,516 | 1/1979 | Jurgens | 267/125 |

*Primary Examiner*—William L. Freeh

*Attorney, Agent, or Firm*—McDermott, Will & Emery

[57] ABSTRACT

An oil well sucker well shock absorber having a cylindrical outer casing, a spring disposed therewithin, a plurality of apertures extending through the casing and allowing fluid communication with upwardly extending slidably disposed piston plunger rod attaching device. Thus, unwanted play and travel and its associated wear can be minimized by force dissipation through the associated spring within the casing.

1 Claim, 3 Drawing Figures

OIL WELL SUCKER ROD SHOCK ABSORBER

This is a continuation of co-pending application Ser. No. 402,417 filed on July 28, 1982, now abandoned.

BACKGROUND OF THE INVENTION

The following invention relates generally to oil well shock absorbers for the sucker rod which pumps oil when reciprocated axially.

The following represents an improvement over my earlier U.S. Pat. No. 3,021,794 entitled "Oil Well Pumping Rod Shock Absorber". In the operation of an oil well pump, the fluid stands somewhere in the pumping valve or cylinder causing the associated well rod to slap in its associated shroud or tubing which results in wearing down of the tubing walls ultimately causing openings to occur. The slap of the rods also result in unnecessary wear with the result that the well is in need of repair relatively prematurely, and it becomes necessary to replace both the worn rods and the tubing. As is common in wells, a section of casing is disposed within the ground and provided with a plurality of perforations at a lowermost portion thereof which encourages the liquid to be pumped to seep therewithin. Annularly disposed within the casing is a further perforated pipe placed below a section of pipe defined as a working barrel and axially aligned therewith. The working barrel extends primarily into a casing section which is nonforaminous and the working barrel includes a means for attachment to the perforated pipe. Slidably disposed therewithin a working valve allows vertical reciprocal motion of a valve rod to pump the oil up within the "working barrel". Thus, a stand valve which discourages fluid migration in one direction and the working valve operate in concert to cause unidirectional fluid flow up within the working barrel, the working valve attached to the surface by means of a valve rod and ultimately the oil well sucker rod shock absorber according to the instant invention. Disposed imediately above the sucker rod shock absorber a sucker rod is attached so that the oil well sucker rod shock absorber comes into play when the working valve and its associated valve rod bottom out, a phenomena know as "pounding the level".

The following patents reflect the state of the art of which applicant is aware insofar as these citations appear germane to the process at hand.

U.S. Pat. No. 2,087,590, Brazell

U.S. Pat. No. 2,834,294, Schoen.

Brazell teaches the use of a known prior art device suitably formed and adapted to remove sand from a well proximate to where the pump is located. To this end, a pump is lowered into a well until it is obvious that the pump has landed on the bottom, and a plunger associated therewith will move downwardly to the lower end of the pump when the tension on a cable associated therewith is released. Fluid beneath the plunger passes upwardly through mandrel, past the valve and out the opening. Once the upward pull of the cable is effected, the plunger will move upwardly and a load of sand will be drawn from the reservoir into the barrel. As the plunger is elevated, spring will yield and be placed under a certain amount of compression thus acting as a shock absorber to the extent of relieving the sudden tension on a cable when the plunger has reached the limit of upward movement. At that point the spring will expand to its former position. Thus, the spring associated therewith merely serves to assure that the plunger will return to an original position and its inherent spring qualities serve to damp the momentum associated with extreme cable motion.

Similarly, the patent to Schoen relates generally to a shifter device reciprocating with a connecting rod and hence with the sucker pump. An overtravel spring cage and its associated spring provide overtravel compensation for the shifter device as shown in FIG. 2. Clearly, the structure associated therewith is prone to "a fluid block" due in part to the incompressibility of the associated fluid, and its likelihood of seepage into the overtravel area, providing a hydraulic ram effect, contrary to its intended purpose.

By way of contrast therefore, the instant invention contemplates a shock absorber unit designed to be positioned on the lower end of a well rod whereby the operation of the well rod is smooth and easy and wherein slap and wear resulting therefrom is reduced to a minimum. To this end, the oil well sucker rod shock absorber according to the instant application is serially connected to a lower portion of a sucker rod disposed first in a working barrel which is annularly inserted within an oil well casing. Thereafter, a lower portion of the sucker rod shock absorber is attached to a valve rod adapted to axially reciprocate in response to sucker rod vertical translation. The valve rod is ultimately connected to a working valve and a stand valve adapted to encourage the unidirectional flow of oil or other liquids within the working barrel.

SUMMARY AND OBJECTS OF THE INVENTION

Accordingly, this invention has as an objective the provision of a yielding means defining an improved oil well sucker rod shock absorber.

A further object of this invention is to provide a device of the character described above which prevents slap and undue wear to the oil well pumping rod associated with a pumping operation.

Still yet a further object of this invention is to provide a shock absorber for the lower end of an oil well pumping rod in which the absorber may be attached to well rods now in use.

A further object of the invention is to provide a shock absorber for an oil well pumping rod in which the absorber is of especially simple and economical construction.

It is still yet a further object of this invention to provide a device of the character described above which is extremely durable in construction, safe to use, and lends itself to mass production techniques.

It is still yet a further object of the invention to provide a device of the character described above having generally the form of an outer casing provided with a plurality of apertures to allow migration therein of liquid, a spring disposed therewithin, upper and lower plug members containing the spring therewithin, and a slidable plunger rod passing through the uppermost plug member having a piston end dimensioned substantially as that of the inner cylinder bore, in registry with one end of the spring and adapted to be attached at a remote extremity to a sucker rod whereby vertical reciprocal translation of the sucker rod beyond certain prescribed limits causes spring deflection so that sucker rod operates against the spring deflection and fluid migrates in and out of the associated holes of the tubular casing.

Other objects and advantages will become apparent when considering the following appended drawings taken in conjunction with the ensuing description.

BRIEF DESCRIPTION OF THE DRAWING FIGURES

BRIEF DESCRIPTION OF THE PREFERRED EMBODIMENT

Figure 2:
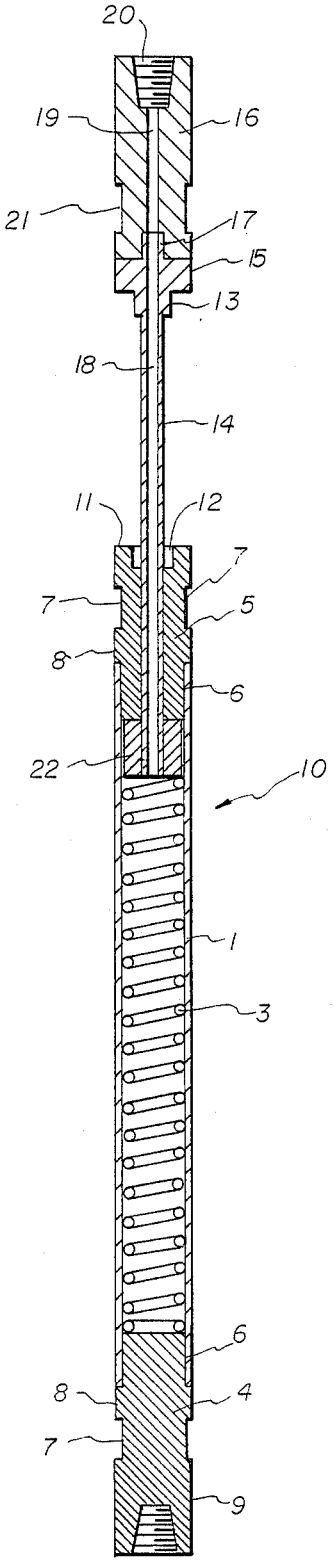
FIG. 2 is a sectional view taken along lines 2—2 of FIG. 1.
Figure 1:
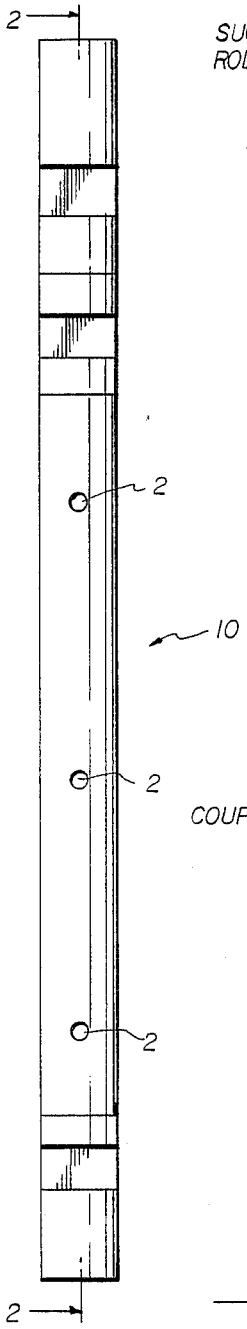
FIG. 1 is side view of the apparatus according to the instant invention.
Figure 3:
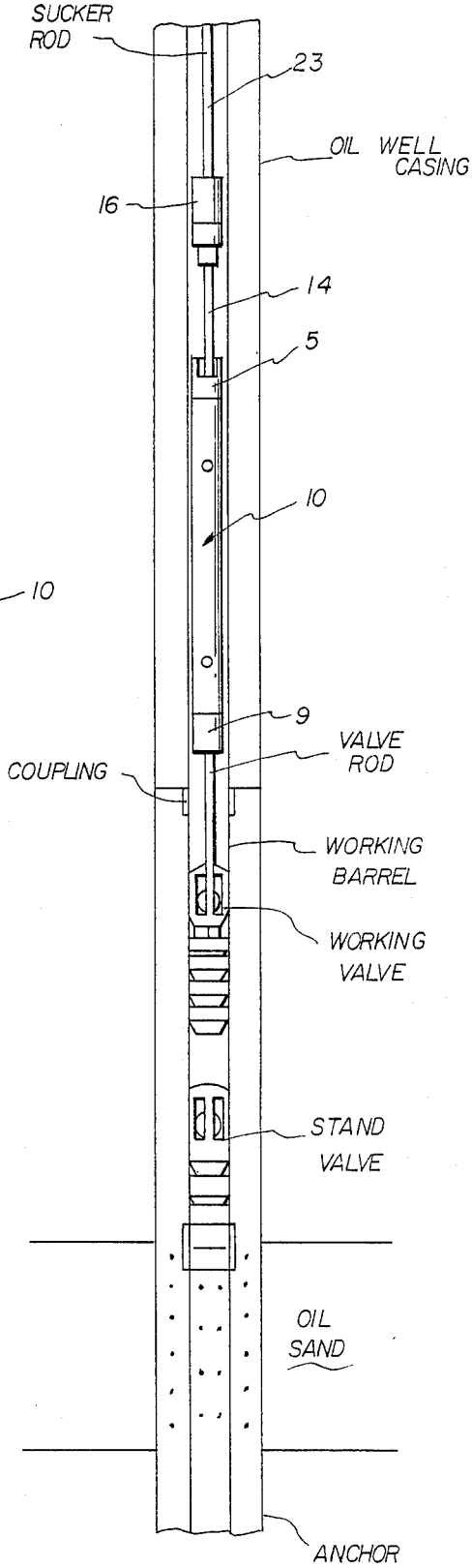
FIG. 3 is a fragmented partial view of the relevant apparatus in its associated environment.

Referring to the drawings wherein like reference numerals refer to like parts throughout the various drawing figures, reference numeral 10 is directed to the oil well sucker rod shock absorber according to the present invention.

As shown in the drawing figures, the shock absorber 10 includes an elongate cylindrical wall 1 having a plurality of apertures 2 disposed through walls thereof, and slidably disposed within the associated inner cylindrical bore, a spring 3 is disposed dimensioned substantially to correspond to the inner diameter of the cylinder. Spring 3 is constrained from displacement without the cylinder by means of a plug member 4 disposed at its lowermost end and a further plug 5 at its upper end. Each upper and lower plug member is threaded through complemental engaging threads 6 extending between the cylinder and the plug, the threads 6 providing a firm and tight fit so that unwanted dissociation of the plug members from the cylinder is not readily achieved. Pairs of diametrically opposed flat areas 7 are disposed on each of the plugs to provide a purchase area for a wrench or the like to assist in the threaded affixion of the plugs within the cylinder. Moreover, an area 8 of substantially cylindrical configuration exists between the wrench purchase area 7 and the threaded portion 6, the cylindrical section being dimensioned to have the same transverse cross section as the cylindrical casing 1, providing a smooth transition from the casing to the upper and lower plug members.

The lower plug 4 has a terminus 9 directly below the wrench purchase area 7 with a bore disposed at its lowermost extremity that is suitably threaded to receive therein an associated valve rod assembly extending down to the working level of the pump. More particularly, the valve rod extends within the working barrel down to the working valve adapted to cooperate with a stand valve disposed at the lowermost portion of the pump which in cooperation with foraminous portions of not only the casing but also the pipe placed below the working barrel allows liquid to be pumped therethrough.

The topmost plug 5 has a top face 11 provided with a recess 12 adapted to receive within limits of the sucker rods strokes a corresponding depending dog 13 attached to a plunger rod 14 capable of reciprocal motion within the shock absorber 10 in a manner to be defined shortly. The dog 13 includes an annular portion 15 dimensioned substantially the same as the cylindrical casing 10, and is threaded to an upper collar 16 by means of a stem 17 threadedly engaging a complementally formed bore in the upper collar 16. The plunger rod 14 has a central bore 18 allowing fluid communication from the shock absorber 10 to extend upward to where the sucker rod is attached. More specifically, the collar 16 includes a central longitudinal bore 19 that communicates with a threaded topmost portion 20 which in turn is rotatably affixed to the sucker rod. To assist in the relative rotation, a purchase area 21 is provided on the upper collar 16 defined similar to the opposed flat areas 7, the purchase area 21 allows the reception thereon of a wrench.

The lowermost portion of the plunger rod 14 has snuggly disposed within the shock absorber 10 a piston plunger 22 dimensioned with a diameter substantially that of the inner diameter of the cylindrical casing 1, and oriented to nest above the spring 3, while allowing the central passageway 18 to provide communication with the interior of the casing 1 so that fluid flow from the interior of the casing 10 and the associated apertures 2 is possible without risking a fluid lock. Thus, when vertical reciprocal motion of the sucker rod 23 extends beyond the limits of the dimension at the lowermost portion of the well, the phenomena known as "pounding the level", damage to the pumping mechanism is averted by compression of the spring 3 under impetus by the piston 22. Fluid migration can occur through the passageway 18 and through the apertures 2 to prevent the damage.

Having thus described the preferred embodiment of the invention, it should be understood that numerous structural modifications and adaptations may be resorted to without departing from the spirit of the invention.

What is claimed is:

1. An oil well sucker rod shock absorber comprising, in combination: an outer cylindrical casing defined by a cylindrical wall and having a removable upper plug means and lower plug means disposed respectively at upper and lower extremities of said casing, said upper plug means having an axial bore and said lower plug means defining a closed lower end and having an upwardly facing top surface; plunger rod means connected to said sucker rod and being slidably disposed in the bore of said upper plug means, a piston within said cylindrical casing and coupled to said plunger rod means and having a downwardly facing bottom surface; biasing means having a maximum vertical length disposed vertically within said casing and extending between said downwardly facing surface of said piston and said upwardly facing surface of said lower plug means at all times for allowing vertical reciprocal translation of said plunger rod means and said piston within said cylindrical casing downwardly against said biasing means; a plurality of apertures disposed through said cylindrical casing along the entire length thereof opposite the length of the biasing means, allowing downhole fluid pressure to be applied to said piston within said cylindrical casing via said apertures to be added to the force of the biasing means, without causing a fluid lock within the cylinder, whereby slap and wear of the sucker rod resulting therefrom are reduced and damage thereto prevented.

* * * * *